US008857933B2

(12) United States Patent
Campion et al.

(10) Patent No.: US 8,857,933 B2
(45) Date of Patent: Oct. 14, 2014

(54) INK SUPPLY RESERVOIR

(75) Inventors: Kevin Campion, Minnetonka, MN (US); Aaron Barclay, Prior Lake, MN (US); Chad Beery, Mound, MN (US); Randy Johnston, Burnsville, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 311 days.

(21) Appl. No.: 13/259,456

(22) PCT Filed: Mar. 8, 2010

(86) PCT No.: PCT/US2010/026536

§ 371 (c)(1),
(2), (4) Date: Sep. 23, 2011

(87) PCT Pub. No.: WO2011/112177

PCT Pub. Date: Sep. 15, 2011

(65) Prior Publication Data

US 2012/0019575 A1 Jan. 26, 2012

(51) Int. Cl.
*B41J 2/195* (2006.01)

(52) U.S. Cl.
USPC ..... 347/7; 347/85; 347/171

(58) Field of Classification Search
USPC ..... 347/7, 85, 86, 171
See application file for complete search history.

(56) References Cited

U.S. PATENT DOCUMENTS

| | | | | |
|---|---|---|---|---|
| 5,583,554 | A * | 12/1996 | Masubuchi et al. | 347/171 |
| 6,698,869 | B2 * | 3/2004 | Vosahlo | 347/85 |
| 7,040,729 | B2 * | 5/2006 | Richards | 347/7 |
| 2010/0192685 | A1 * | 8/2010 | Sabanovic et al. | 73/290 R |

* cited by examiner

*Primary Examiner* — Lam S Nguyen

(57) ABSTRACT

A reservoir of an ink supply system is described.

20 Claims, 5 Drawing Sheets

INK SUPPLY RESERVOIR

BACKGROUND

Inkjet printing systems rely on application of a vacuum or negative pressure on the ink supply to help control or prevent drooling of ink at a printhead by causing and maintaining a meniscus in the ink supply line. However, because of air infiltration due to manufacturing defects or other reasons, a significant or sudden increase can sometimes occur in the level of ink and/or associated foam in the supply system. If this ink or foam enters a vacuum supply in communication with the ink supply line, then a catastrophic contamination of the vacuum control system can occur. Such catastrophic failures result in significant downtown time, as well as posing significant costs to restore the vacuum control system. While various attempts have been made at protecting the vacuum control system, significant challenges still remain.

DETAILED DESCRIPTION

Figure 1:
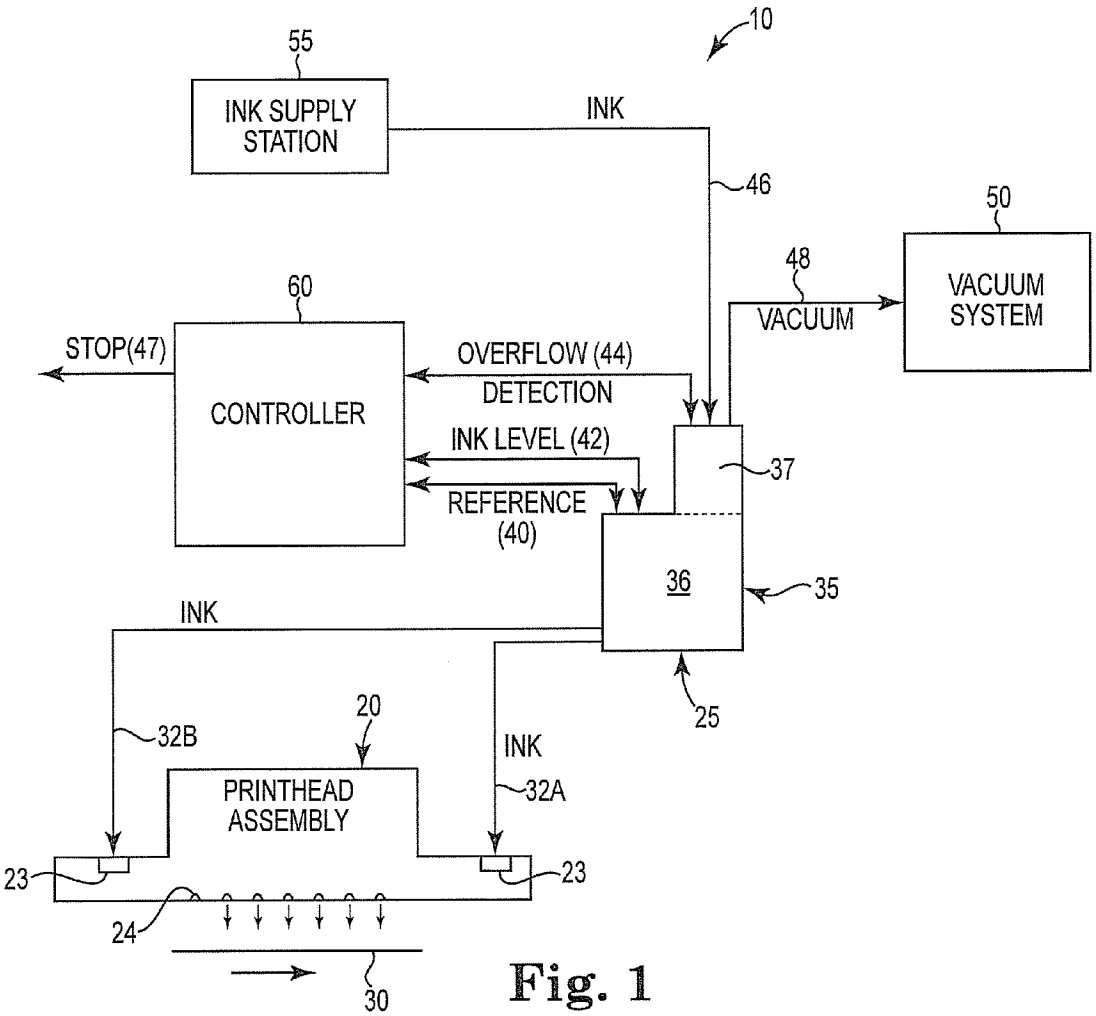
FIG. 1 is a block diagram of an ink supply assembly of a printing system, according to an embodiment of the present general inventive concept.

In the following detailed description, reference is made to the accompanying drawings which form a part hereof, and in which is shown by way of illustration specific embodiments in which the present general inventive concept may be practiced. In this regard, directional terminology, such as "top," "bottom," "front," "back," "leading," "trailing," etc., is used with reference to the orientation of the Figure(s) being described. Because components of embodiments of the present general inventive concept can be positioned in a number of different orientations, the directional terminology is used for purposes of illustration and is in no way limiting. It is to be understood that other embodiments may be utilized and structural or logical changes may be made without departing from the scope of the present general inventive concept. The following detailed description, therefore, is not to be taken in a limiting sense, and the scope of the present general inventive concept is defined by the appended claims.

Embodiments of the present general inventive concept are directed to preventing intrusion of ink and/or foam into a vacuum control system of a printing system. In some embodiments, an ink reservoir within an ink supply assembly includes a first portion for holding a volume of free ink and a second portion with a vacuum port positioned to apply a vacuum on the free ink. The first portion includes an ink level detection mechanism which facilitates maintaining a level of ink within a predetermined volume range within the first portion. The second portion defines a generally hollow chamber that houses a sensor vertically spaced above, and exposed to, the first portion. The sensor is positioned to receive contact from, and to electronically detect, foam and/or ink that rises out of the first portion and into the chamber when an external interferent, such as air, leaks into the vacuum-controlled ink supply. In some embodiments, the sensor comprises a resistive-based temperature sensor. Upon detection via the sensor of the rising ink or foam level, an alert is triggered to stop printing and/or stop supplying ink in order to prevent further rise of the ink within the chamber of the second portion. This response prevents a catastrophic intrusion of ink and/or foam into the vacuum supply line. In one aspect, the chamber of the second portion is sized and shaped to induce a natural reduction or dissipation of froth that results from air infiltration into the ink supplied under vacuum to the printhead. In particular, the second portion has a cross-sectional area and/or height that are substantially greater than a maximum diameter of bubbles from the froth. This relationship inhibits adhesion of froth to the walls of the chamber of the second portion, and consequently induces the froth to collapse prior to building up to a significant volume.

In this way, embodiments of the present general inventive concept prevent or reduce the potential for catastrophic intrusion of ink and/or foam into a vacuum control system of a printing system.

These embodiments, and additional embodiments, are described and illustrated in association with FIGS. 1-4.

A printing system 10, according to an embodiment of the present general inventive concept, is illustrated by FIG. 1. As shown in FIG. 1, system 10 includes a printhead assembly 20 and various elements of an ink supply system 25 including, but not limited to, an ink reservoir 35, vacuum system 50, ink supply station 55, and controller 60. The printhead assembly 20 ejects drops of ink through orifices or nozzles 24 and toward a print media 30 so as to print onto print media 30. In some embodiments, printhead assembly 20 comprises a piezoelectric printhead, while in other embodiments, printhead assembly 20 comprises a thermal inkjet printhead.

Ink is supplied to printhead assembly 20 via fluidic communication between ports 23 and supply lines 32A, 32B, which extend from ink reservoir 35. Ink reservoir 35 includes a first portion 36 that holds a volume of free ink and a second portion 37. In some embodiments, ports 23 and/or supply lines 32A, 32B correspond to one general location at which froth-causing infiltration of air may occur.

As will be described in more detail in association with FIGS. 2-3B, first portion 36 includes an ink level detection mechanism used to ensure that an adequate level of ink is maintained in the first portion. In some embodiments, this detection information regarding ink level is communicated via an ink level signal 42 and a reference signal 40 to the controller 60 for further processing. It will be understood that in some embodiments, in addition to controlling components of ink supply system 25, controller 60 also controls operation of printhead assembly 20 and/or other components of printing system 10, as known to those skilled in the art.

In some embodiments, the second portion 37 defines a generally hollow chamber that normally is empty to allow application of a vacuum 48 from vacuum system 50 onto the free ink in first portion 36 in order to cause and maintain a meniscus on the ink supplied to printhead assembly 20. In some embodiments, ink is supplied from ink supply station 55 via supply line 46 directly into the first portion 36 while in other embodiments, ink supply line 46 passes through a conduit extending through second portion 37 before ink exits into the first portion 36 of reservoir 35, as will be further described and illustrated in association with at least FIGS. 2A-2B.

As will be described in more detail in association with FIGS. 2-3B, in some embodiments, second portion 37 includes an overflow detection mechanism used to detect a rise in ink and/or foam (from the first portion 36 into the second portion 37) with this detection information being communicated via an overflow detection signal 44 to the controller 60 for further processing. In particular, upon receiving an active overflow detection signal 44, controller 60 produces a stop signal 47 that causes termination of printing, supplying ink, etc. in an attempt to stop the rise of ink and/or foam within second portion 37 toward vacuum line 48 and vacuum system 50.

Figure 2A:
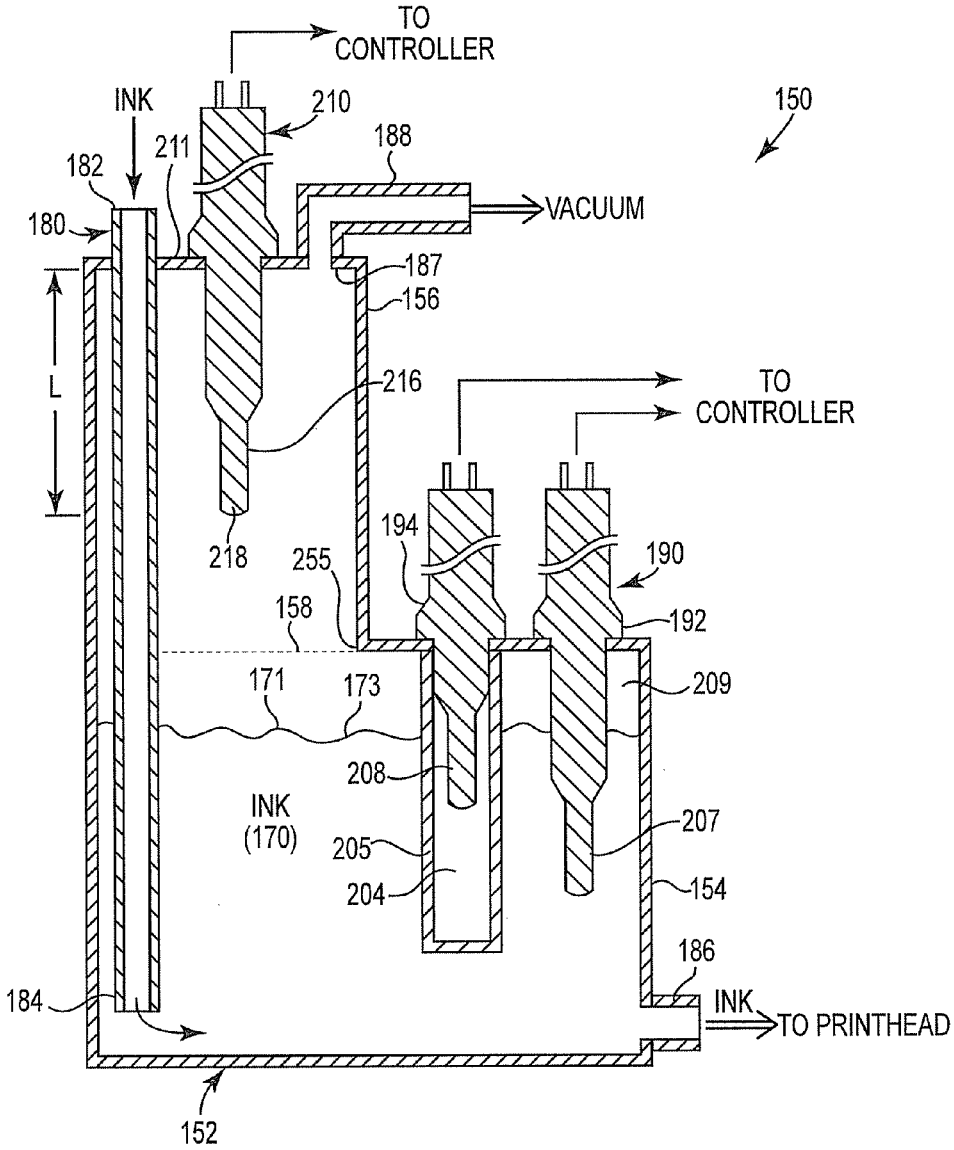
FIG. 2A is sectional view schematically illustrating an ink reservoir assembly, according to an embodiment of the present general inventive concept.

FIG. 2A is a sectional view of an ink reservoir 152 of an ink supply system, according to an embodiment of the present general inventive concept. In one embodiment, the reservoir 152 comprises at least substantially the same features and attributes as reservoir 35, as previously described in association with FIG. 1. As illustrated by FIG. 2A, reservoir 152 includes a first portion 154 and a second portion 156 with dashed line 158 representing a boundary between the respective portions 154, 156. First portion 154 holds a volume of free ink 170 and includes an exit port 186 (such as a manifold) to supply ink to one or more printheads. First portion 154 also includes a level detection mechanism 190. It will be understood that the level of ink within first portion 154 will vary between ink-fill cycles. Accordingly, in one embodiment, first level 171 represents the level of ink upon a fill of ink such that level 171 represents a maximum level of ink in first portion 154 in the normal operating range of reservoir 152.

In one embodiment, this ink level detection mechanism 190 includes a first thermistor 194 and a second thermistor 192. The respective thermistors 192, 194 are used to detect and indicate whether the ink within first portion 154 is maintained within the normal operating range. In particular, first thermistor 194 establishes a reference value by positioning probe 208 within air chamber 205, which isolates probe 208 from ink 170. On the other hand, probe 207 of ink thermistor 192 is normally exposed to ink 170 within first portion 154. Accordingly, a comparison of the values detected via the respective thermistors 192, 194 yields a generally known difference associated with steady state operation of the ink supply system. However, when the level of ink 170 drops within first portion 154 below first level 171, probe 207 of ink thermistor 192 becomes increasingly exposed to air 209 within first portion 154, thereby causing a change in the value detected via thermistor 192. Upon detecting this change in the difference between the values of the respective thermistors 192, 194, an altered or low ink status is indicated, and then an ink-fill cycle can be initiated. Moreover, it will be further understood that as the level of ink 170 level varies within the first portion 154, but still is in contact with probe 207 of thermistor 192, an approximation is made of the relative level of ink within first portion 154.

Figure 2B:
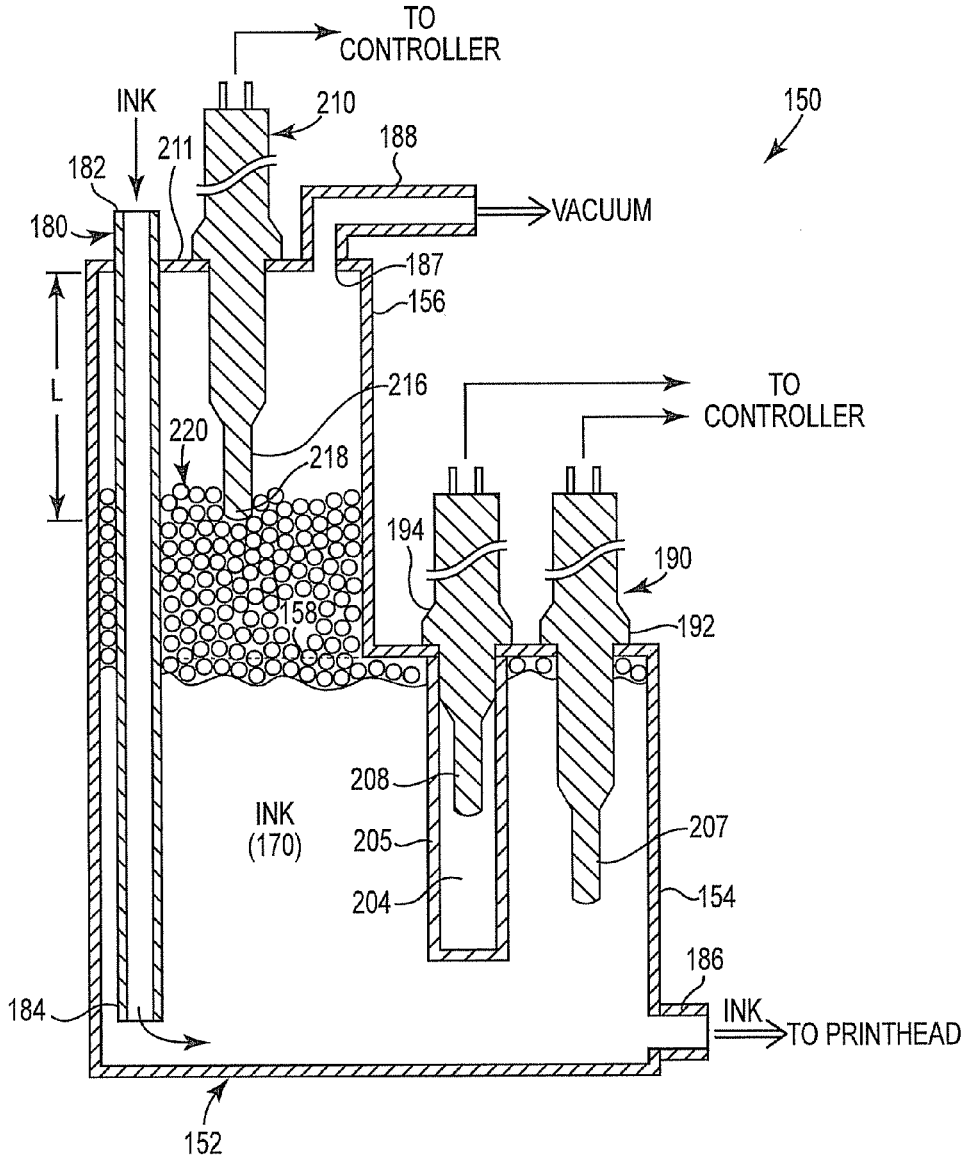
FIG. 2B is sectional view schematically illustrating an ink reservoir assembly, according to an embodiment of the present general inventive concept.

It will be further understood that other types of ink-level detection mechanisms can be used in first portion 154, such as known float-based detection mechanisms, instead of using the array of thermistors 190, 192 as depicted in FIGS. 2A-2B.

Second portion 156 of reservoir 152 defines a generally hollow chamber that is positioned above, and in communication with, first portion 154. In one aspect, second portion 156 includes one or more vacuum ports 188 for connection to a vacuum supply line (48 in FIG. 1) so that a vacuum is applied via second portion 156 to the free ink 170 in first portion 154, and thereby applied to the ink supplied to a printhead assembly (20 in FIG. 1). In addition, in some embodiments, second portion 156 includes an ink supply port 182 (of a conduit 180) for receiving ink from an ink supply station (55 in FIG. 1) with the supplied ink being transported via conduit 180 for release at end 184 directly within first portion 154, as illustrated in FIG. 2A. In other embodiments, the ink supply port 182 is located at an exterior of first portion 154 and a conduit (similar to conduit 180) extends into first portion 154 such that conduit 180 does not pass through second portion 156.

Second portion 156 also includes a sensor 210 configured to detect a presence or absence of ink and/or foam within the chamber of second portion 156 by detecting contact (or a lack of contact) of ink and/or foam relative to sensor 210. In one embodiment, sensor 210 is a resistive-based temperature sensor, such as a thermistor, that produces different voltage signals depending upon whether there is contact between (or a lack of contact between) a liquid and probe 216 of sensor 216.

In one embodiment, sensor 210 is mounted to a top portion 211 of second portion 156 so that probe 216 of sensor 210 protrudes through second portion 156 toward, but vertically spaced apart from, the free surface 173 of ink 170 in first portion 154. Upon a rise of ink and/or foam 220 within second portion 156 that contacts probe 216, as illustrated by FIG. 2B, sensor 210 triggers a stop signal (47 in FIG. 1) to terminate printing and/or terminate further supply of ink to first portion 154 in order to prevent the further rise of ink and/or foam, which could then enter vacuum line 188.

In one embodiment, probe 216 includes an elongate shape and is configured with a length L (as measured between end 218 and top portion 211) so that upon detection of ink and/or foam at end 218 of probe 216, a sufficient amount of time will be available to terminate printing and/or terminate supply of ink to first portion 154 to prevent a rise in ink and/or foam up to vacuum port 188. In other words, if the probe 216 were substantially shorter than length L, even upon detecting the presence of ink and/or foam within second portion 156, there would not be enough time to stop the printing or supply of ink quick enough to avert a catastrophic intrusion of ink and/or foam into vacuum port 188 and the vacuum system (50 in FIG. 1). In one embodiment, the length L is about one-half inch.

In another aspect, second portion 156 is sized and shaped to induce natural reduction or dissipation of froth within reservoir 152 and thereby prevent intrusion of such foam into vacuum line 188 via port 187. In particular, second portion 156 is configured with a height (above the opening 155 of first portion 154) and/or a transverse cross-sectional area (e.g. width and length) that is substantially greater than a maximum diameter of froth bubbles caused by air infiltration. The substantially greater cross-sectional area and/or height does not support adhesion of froth bubbles to the walls of second portion 156, and therefore results in a collapse of the froth prior to it building up to a problematic height. Moreover, by providing both the respective first and second portions 154, 156 with a relatively large volume, small fluctuations in the volume of free ink in first portion 154 will not result in a quick or significant change in the height or level of ink within the first portion 154. This arrangement minimizes the chance of intrusion into the second portion 156 and/or vacuum line 188. Moreover, by sizing first portion 154 and second portion 156 to accommodate small fluctuations in volume of free ink during normal functioning of the ink supply system, reservoir 152 is configured to minimize "false positive" identifications of ink overflow that might otherwise be produced by small fluctuations in the volume of free ink.

Figure 3:
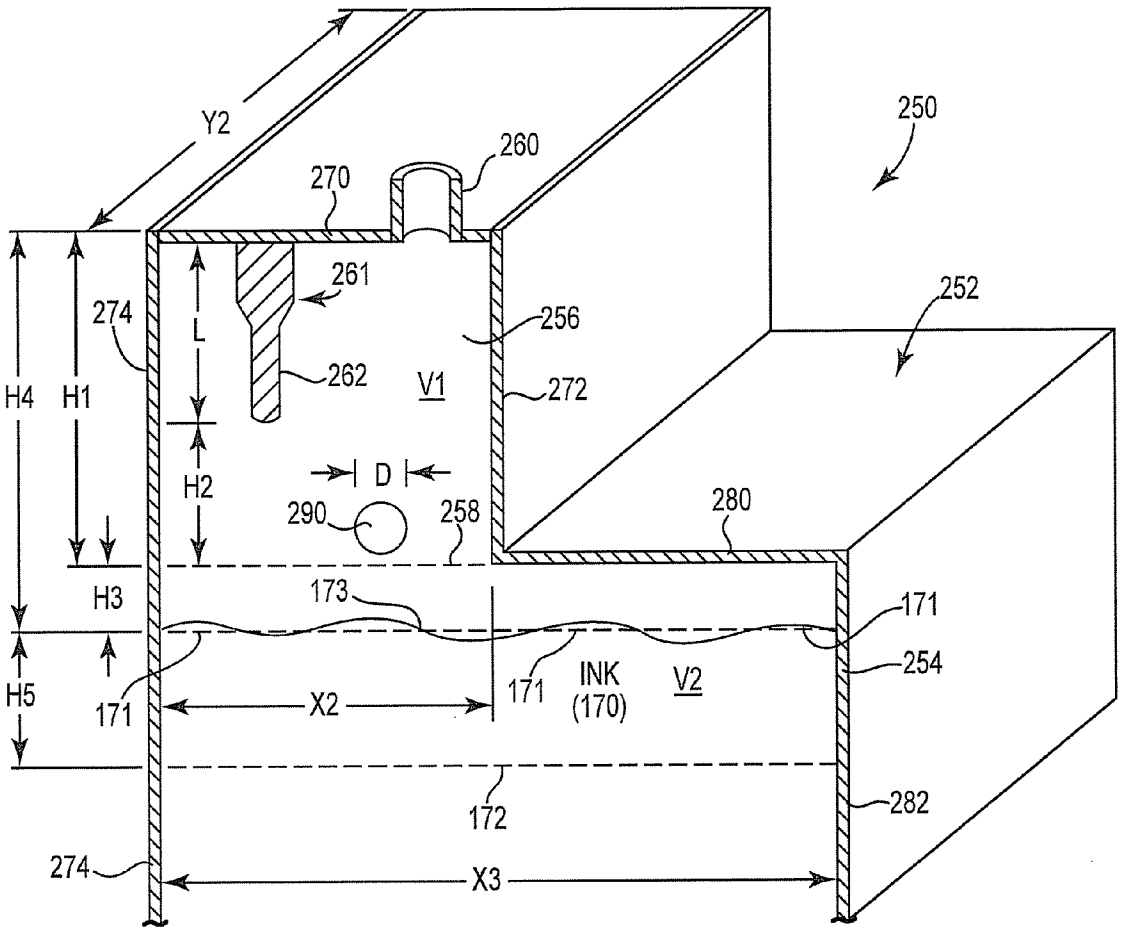
FIG. 3 is a sectional view schematically illustrating an ink reservoir, according to an embodiment of the present general inventive concept.

FIG. 3 is a partial sectional view schematically illustrating a reservoir 252 of an ink supply system 250, according to an embodiment of the present general inventive concept. In one embodiment, the reservoir 252 comprises at least substantially the same features and attributes as reservoir 35,152, as previously described and illustrated in FIGS. 1 and 2A, respectively.

As illustrated in FIG. 3, reservoir 252 includes a first portion 254 and a second portion 256 with dashed line 258 representing a boundary between the respective portions 254, 256 at opening 255 of first portion 254. FIG. 3 schematically depicts some of the spatial-dimensional relationships between a first portion 254 and a second portion of a reservoir 252, as well as froth bubbles 290. In one embodiment, the first portion 254 includes a first side wall 282, top wall 280, and opposite side wall 274. The second portion 256 includes a first side wall 272, opposite side wall 274, and top wall 270. The second portion 256 includes a width (X2), a height (H1), and a length (Y2).

Second portion 256 includes a vacuum port 260 at top wall 270. Within second portion 256, sensor probe 261 extends downward from the top wall 270 and includes a length (L) such that an end 262 of probe 261 is spaced apart by a distance (H2) vertically above a top (represented by boundary line 258) of first portion 254 at opening 255. In one embodiment, the distance H2 is one-half inch while the length L of the sensor probe 261 is about one-half inch so that the end 262 is about one-half inch away from an entrance of the vacuum port 260.

Accordingly, it will be understood that with probe end 262 positioned within the chamber at a first vertical distance (H2) above opening 255 of the first portion 254 into the chamber 256, the first vertical distance (H2) is substantially greater than a maximum diameter of a froth bubble producable from the ink in the first portion (as described in more detail below). Moreover, a second vertical distance (represented by length L) between the vacuum port 260 and the end 262 of the first sensor 261 is generally equal to or greater than the first vertical distance (H2). This latter relationship ensures that even if some froth bubbles 290 reach end 262 of probe end 261 (which will result in probe 261 triggering cessation of printing and/or supplying ink), the second vertical distance is still substantially greater than the maximum diameter froth bubbles producable from the ink held in the first portion. Therefore, any such froth bubbles reaching end 262 will not be in a position to penetrate or intrude into vacuum port 260 at the time that printing or ink supply is terminated because the second vertical distance (L) is substantially greater than the maximum diameter of such froth bubbles.

As in the prior embodiments, the sensor probe 261 includes, but is not limited to, a resistive-based temperature sensor such as a thermistor.

Bubble 290 represents a maximum size (represented by diameter D) of a froth bubble caused by infiltration of air into the ink supply system. It will be understood that the size of the bubble is enlarged for illustrative clarity and that there will be some variance between the sizes of bubbles in the froth.

Bubble 290 has a diameter D that is substantially less than a width (X2), length (Y2), or a height (H1) of second portion 256. In other words, the width, length, and height of second portion 256 is substantially greater than a maximum diameter of a froth bubble(s) 290, such that the bubbles tend to collapse on themselves before they are able to collect and cause a rising level of foam or froth that would intrude into vacuum port 260. In some embodiments, given predetermined ink parameters, a diameter of the free surface 173 of the ink (as determined by a diameter X2 of the first portion 254) is substantially greater than the demonstrated maximum bubble dimensions (represented by diameter D) at or above the free surface 173 of ink for bubbles 290 (or bubbles 220 in FIG. 2B) caused by a submerged air leak (i.e. air leaking into the ink that is supplied, under vacuum, to the printhead). In one embodiment, a diameter of the free surface 173 of the ink (as determined by a diameter X2 of the first portion 254) is five times greater than the demonstrated maximum bubble dimensions (represented by diameter D) at or above the free surface 173 of ink for bubbles 290 (or bubbles 220 in FIG. 2B) caused by a submerged air leak (i.e. air leaking in the ink that is supplied, under vacuum, to the printhead). In one embodiment, the ink parameters associated with this relationship (the diameter of free surface of ink relative to maximum bubble dimensions) include, but are not exclusively limited to, inks exhibiting a surface energy range of about 28 to 31 dynes per centimeter and having viscosities, which range from about 3 to 25 centipoises.

In one embodiment, the distance X2 across the opening 255 of the first portion 254 into the chamber of second portion 256 is about two-thirds the distance X3 across the full width of the first portion 254. Assuming a generally equal length (represented by Y2) for both first portion 254 and second portion 256, then the opening 255 has a cross-sectional area about two-thirds the cross-sectional area of the first portion 254. This cross-sectional area of opening 255 is also substantially greater than (such as, but not limited to, three times greater) than a maximum diameter of froth bubbles.

It will be understood, of course, that the presence of sensor probe 261 also acts as a further safeguard to detect the presence of foam or froth, in the event that a rapid rise in ink and/or foam occurs despite the dimensions of the second portion 256 being substantially larger than the maximum dimensions bubbles 290 of the foam or froth.

In one embodiment, the first level 171 of ink 170 corresponds to a maximum height of ink 170 upon a fill cycle that introduces ink from an ink supply station (e.g., station 55 in FIG. 1) in reservoir. With this in mind, a combined height H4 (i.e. elevation) of the volume of air in the chamber (H1) and in upper portion (H3) of the reservoir is substantially greater than a first change in elevation (H5) of ink 170 in a reservoir fill cycle. In one embodiment, the combined height (H4) of the volume of air in the chamber (H1) and of the upper portion (H3) of the reservoir is three times greater than a change in elevation (H5) of ink in a reservoir fill cycle. As will be understood, the change in elevation corresponds to the difference between the minimum and maximum volume of ink 170 in first portion 254 within a normal operating range of reservoir 252.

In some embodiments, a controlled vacuum volume (V1) of air over the free ink surface 173 is substantially greater than the volume (V2) of ink in an individual fill cycle in first portion 254. In one aspect, the volume V2 corresponds to the ink between first level 171 and second level 172. In one embodiment, the controlled vacuum volume (V1) of air over the free ink surface is five times greater than the volume (V2) of ink in an individual fill cycle in first portion 254.

With this arrangement, opening 255 of first portion 254 has a cross-sectional area that is substantially larger than the maximum bubble diameter and the chamber of second portion 256 has a sufficiently large volume, such that any froth bubbles that begin to form due to air infiltration into the ink supply line (under vacuum) quickly collapse on themselves, and thereby prevent a rise of ink and/or froth into vacuum port 260.

Accordingly, in these arrangements, froth produced from ink (due to a submerged air leak in the vacuum-controlled supply of ink) would have to overcome several obstacles before intruding into vacuum port 260. First, any such froth bubbles 290 would have to survive, without collapsing on themselves, the substantially larger cross-sectional area of the opening 255 of the first portion 254 and the substantially larger height of the chamber 256. Second, even if such froth bubbles rose vertically within chamber 256 without collapse, their contact with end 262 of probe 261 would cause a shutdown of the ink supply and/or printing, thereby limiting further rise of the froth. Third, even if such froth bubbles reached end 262 of probe 261 and triggered a shutdown, the distance (represented by L) from end 262 to vacuum port 260 is substantially larger than the maximum froth bubble dimensions, and therefore such froth bubbles at probe end 262 would not reach vacuum port 260. Instead, they would either self-collapse or recede after cessation of printing or supply of ink. Consequently, either the sensor probe 262 within chamber 256 alone or the dimensional relationships of chamber 256 and first portion 254 alone can prevent froth from catastrophically entering vacuum port 260. However, the combination of the sensor probe 262 within chamber 256 and the dimensional relationships of chamber 256 (relative to first portion 254 and/or relative to properties of the ink, such as maximum bubble size) provide an even more robust mechanism to prevent froth bubbles from entering vacuum port 260.

Figure 4:
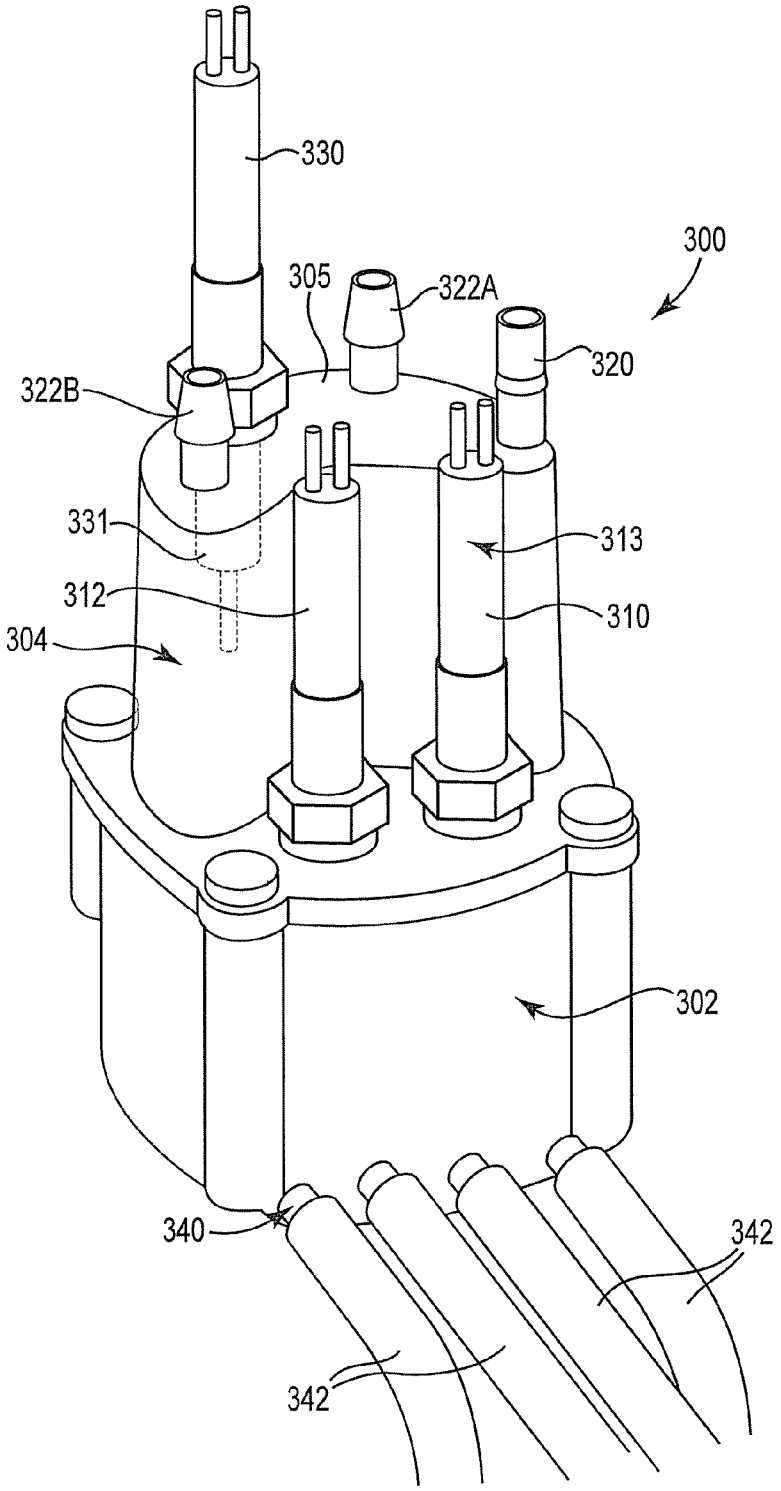
FIG. 4 is a perspective view of an ink reservoir assembly, according to an embodiment of the present general inventive concept.

FIG. 4 is a perspective view of an ink reservoir 300 of an ink supply system, according to an embodiment of the present general inventive concept. In one embodiment, the reservoir 300 comprises at least substantially the same features and attributes as reservoirs 35, 150, 252 as previously described in association with FIGS. 1, 2A, 3, respectively. As illustrated by FIG. 4, reservoir 300 includes a first portion 302 and a second portion 304. First portion 302 holds a volume of free ink (not shown) supplied from an ink supply station (e.g., station 55 in FIG. 1) and includes a manifold 340 configured to supply ink to ink supply lines 342 for delivery to one or more printheads. First portion 302 also includes a level detection mechanism 313 similar to ink level detection mechanism 190, as previously illustrated and described in association with FIG. 2A. In one embodiment, this ink level detection mechanism 313 includes an air-detection thermistor 312 and an ink-detection thermistor 310, like thermistors 192, 194 of FIG. 2A.

Second portion 304 defines a generally hollow chamber that is positioned above and in communication with first portion 302. In one aspect, second portion 304 includes one or more vacuum ports 122A, 122B (like vacuum port 188 in FIG. 2A). In addition, in some embodiments, second portion 304 includes an ink supply port 320 like ink supply port 182 in FIG. 2A. Second portion 304 also includes a resistive-based temperature probe 330, like sensor 210 in FIG. 2A.

In some embodiments, the size and shape of the second portion 256 will not completely prevent a rise of foam or froth toward the vacuum port. However, the generally hollow chamber defined by second portion 256 establishes a sufficiently large volume to provide a time margin for a controller to slow the relative rate of accumulation of foam or froth within second portion 256, and thereby avoid a catastrophic intrusion into the vacuum port 260. In particular, upon contact of the rising foam and/or froth with the probe end 262 of thermistor 261, and the ensuing triggering of a "stop printing" command or "stop supplying ink" command, the slow rate of accumulation (provided by the large volume of second portion 304) will allow enough time for the effect of these "stop" commands to take place. This arrangement, in turn, reduces or reverses the rate of accumulation of froth within second portion 256 and thereby prevents intrusion of froth into vacuum port 260 and its associated vacuum line. Moreover, the length (L) of probe 261 is selected so that this length, in combination with the cross-sectional area (width vs. length) and height of second portion 256, provides a sufficient time margin (after issuing a stop command) for the rise of foam and/or froth to be stopped or reversed before the foam and/or froth would reach vacuum port 260.

Embodiments of the present general inventive concept are directed to preventing intrusion of ink and/or foam into a vacuum-meniscus control system. By preventing a catastrophic intrusion of ink and/or foam into a vacuum-meniscus control system, these embodiments prevent costly downtimes and/or replacement of system components.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An ink supply system comprising:

a reservoir including:

a first portion configured to receive a supply of ink and to hold a volume of free ink, the first portion at least one exit port configured to supply ink to a printhead, wherein the first portion includes an ink level detection mechanism configured to detect the level of free ink in the first portion to maintain the level of free ink with a predetermined volume range; and a second portion defining a generally hollow chamber positioned vertically above, and in communication with, the first portion, and including:

at least one vacuum port vertically spaced apart from the first portion and exposed to apply vacuum pressure on the free ink: and a first sensor vertically spaced apart from the first portion and positioned within the chamber, the first sensor configured to trigger, upon contact from ink in the second portion, termination of the supply of ink or printing via the reservoir, wherein the first sensor is separate from, and independent of, the ink level detection mechanism.

2. The ink supply system of claim 1, wherein the first sensor is mounted on a top wall of the second portion adjacent the at least one vacuum port and projects through the chamber toward the first portion, and wherein at least a portion of the ink level detection mechanism is mounted to a top wall of the first portion and is positioned within the first portion, wherein the top wall of the first portion is separate from, and independent of, the top wall of the second portion, with the top wall of the second portion spaced vertically apart from the top wall of the first portion.

3. The ink supply system of claim 2, wherein the first sensor comprises an elongate resistive-based temperature sensor that includes a probe end positioned within the chamber at a first vertical distance above an opening of the first portion into the chamber, wherein the first vertical distance is configured to be substantially greater than a maximum diameter of a froth bubble producible from the ink in the first portion.

4. The ink supply system of claim 3, wherein a volume of the chamber is substantially greater than a maximum diameter froth bubbles producible from the ink held in the first portion.

5. The ink supply system of claim 4, wherein both the first vertical distance and a cross-sectional area of an opening of the first portion into the chamber of the second portion are substantially greater than the maximum diameter of the producible froth bubbles.

6. The ink supply system of claim 5, wherein a second vertical distance between the vacuum port and the end of the first sensor is generally equal to or greater than the first vertical distance.

7. The ink supply system of claim 1, comprising:

a vacuum source operatively coupled to the vacuum port of the second portion;

a controller operatively coupled to the first sensor; and an ink supply operatively coupled to an intake port positioned on at least one of the first portion or the second portion of the reservoir and configured to release ink directly into the first portion.

8. The ink supply system of claim 1, comprising:

an ink conduit including:

an inlet end connectable to an ink supply external to the reservoir; and an outlet end positioned within the first portion to be directly exposed to, and positioned within, the volume of free ink within the first portion.

9. The ink supply system of claim 1, wherein an opening is defined at a junction of the first portion and the second portion, and the opening has a width less than a full width of the first portion.

10. The ink supply system of claim 1, wherein the second portion defines a controlled vacuum volume over the free ink in the first portion, with the controlled vacuum volume being about five times greater than a volume of ink in an individual fill cycle in the first portion.

11. The ink supply system of claim 1, wherein the first sensor is vertically spaced above a maximum fill line of free ink within the first portion.

12. A printing system comprising:

a printhead;

a reservoir including:

a first portion configured to receive a supply of ink and to hold a volume of free ink, the first portion at least one exit port operatively coupled to supply ink to the printhead, wherein the first portion includes an ink level detection mechanism configured to detect the level of free ink in the first portion to maintain the level of free ink with a predetermined volume range; and a second portion defining a generally hollow chamber positioned vertically spaced above, and in communication with, the first portion, and including:

at least one vacuum port vertically spaced apart from the first portion and exposed to apply vacuum pressure on the free ink: and a first temperature sensor positioned within the chamber and vertically spaced above the first portion, the first sensor configured to trigger, upon contact from ink in the second portion, termination of the supply of ink or printing via the reservoir, wherein the first sensor is mounted on a top wall of the second portion and projects through the chamber toward the first portion, the first sensor including a probe end positioned at a first vertical distance above an opening of the first portion into the chamber, wherein the first vertical distance is configured to be substantially greater than a maximum diameter froth bubble producible from the ink, a controller operatively coupled to the first sensor, wherein the first sensor is separate from, and independent of, the ink level detection mechanism; and an ink supply operatively coupled to an intake port positioned on at least one of the first portion or the second portion of the reservoir and having an outlet end positioned to release ink directly within the first portion.

13. The printing system of claim 12, wherein both the first vertical distance and a cross-sectional area of an opening of the first portion into the chamber of the second portion are substantially greater than the maximum diameter of the producable froth bubbles.

14. The printing system of claim 13, wherein a second vertical distance between the vacuum port and the end of the first sensor is generally equal to or greater than the first vertical distance.

15. The printing system of claim 12, comprising:

an ink conduit including:

an inlet end connected to the ink supply; and an outlet end positioned within the first portion to be directly exposed to, and positioned within, the volume of free ink within the first portion.

16. A method of supplying ink, comprising:

interposing an ink reservoir between a printhead and a vacuum conduit;

holding a volume of free ink within a first portion of the ink reservoir and supplying ink from the first portion, via an exit port, to a printhead;

providing an ink level detection mechanism in the first portion;

providing a hollow chamber vertically above, and exposed to, the ink in the first portion and applying a vacuum, via a vacuum port of the chamber, to the ink in the first portion;

providing a first sensor within the chamber that is vertically spaced apart from, and exposed to, the ink in the first portion, wherein the first sensor is separate from, and independent of, the ink level detection mechanism; and upon detecting contact of ink or foam with the first sensor within the second portion, preventing entry of the ink or foam into the vacuum conduit via stopping at least one of supplying ink to the first portion or printing via the printhead.

17. The method of claim 16, comprising:

arranging the first sensor to extend from a top wall of the second portion and project through the chamber toward the first portion;

positioning a probe end of the first sensor at a first vertical distance above an opening of the first portion into the chamber, wherein the first vertical distance is substantially greater than a maximum diameter froth bubble producible from the ink.

18. The method of claim 17, comprising:

arranging at least a portion of the ink level detection mechanism to extend from a top wall of the first portion and into the first portion, wherein the top wall of the first portion is separate from, and independent of, the top wall of the second portion.

19. The method of claim 16, comprising:

arranging a size and a shape of the chamber to cause both the first vertical distance and a cross-sectional area of an opening of the first portion into the chamber of the second portion to be substantially greater than the maximum diameter of the producable froth bubbles; and arranging a second vertical distance between the vacuum port and the end of the first sensor to be generally equal to or greater than the first vertical distance.

20. The method of claim 16, comprising:

arranging an inlet end of an ink conduit to be connectable to an ink supply external to the reservoir and arranging an outlet end of the ink conduit within the first portion to be directly exposed to, and positioned within, the volume of free ink within the first portion.

* * * * *

UNITED STATES PATENT AND TRADEMARK OFFICE

CERTIFICATE OF CORRECTION

PATENT NO. : 8,857,933 B2
APPLICATION NO. : 13/259456
DATED : October 14, 2014
INVENTOR(S) : Kevin Campion et al.

It is certified that error appears in the above-identified patent and that said Letters Patent is hereby corrected as shown below:

In the Specification,

In column 5, line 30, delete “producable” and insert -- producible --, therefor.

In column 5, line 40, delete “producable” and insert -- producible --, therefor.

In the Claims,

In column 10, lines 6-7, in Claim 13, delete “producable” and insert -- producible --, therefor.

In column 10, line 60, in Claim 19, delete “producable” and insert -- producible --, therefor.

Signed and Sealed this
Thirty-first Day of March, 2015

Michelle K. Lee

Michelle K. Lee
*Director of the United States Patent and Trademark Office*